US009649531B2

(12) United States Patent
Peterson et al.

(10) Patent No.: US 9,649,531 B2
(45) Date of Patent: May 16, 2017

(54) MOBILE PRACTICE DUMMY

(75) Inventors: Robert L. Peterson, Beaverton, OR (US); Robert James Undrill, Portland, OR (US)

(73) Assignee: Allied Power Products, Inc., Beaverton, OR (US)

( * ) Notice: Subject to any disclaimer, the term of this patent is extended or adjusted under 35 U.S.C. 154(b) by 833 days.

(21) Appl. No.: 13/215,049

(22) Filed: Aug. 22, 2011

(65) Prior Publication Data

US 2013/0053189 A1 Feb. 28, 2013

(51) Int. Cl.

| | |
|---|---|
| ***A63B 69/34*** | (2006.01) |
| ***A63B 69/00*** | (2006.01) |
| ***A63B 24/00*** | (2006.01) |
| *A63B 71/02* | (2006.01) |

(52) U.S. Cl.

CPC ..... *A63B 24/00* (2013.01); *A63B 69/345* (2013.01); *A63B 2071/025* (2013.01); *A63B 2209/10* (2013.01); *A63B 2225/54* (2013.01); *A63B 2243/007* (2013.01)

(58) Field of Classification Search

CPC ... A63B 24/00; A63B 69/345; A63B 2209/10; A63B 2225/54; A63B 2243/007

USPC ..... 473/422, 438–445, 447, 448, 471, 481, 473/42; 273/359, 368; 446/236, 265, 446/288, 275

See application file for complete search history.

(56) References Cited

U.S. PATENT DOCUMENTS

| | | | | | |
|---|---|---|---|---|---|
| 2,237,599 | A | * | 4/1941 | Gilman | 473/444 |
| 2,250,215 | A | * | 7/1941 | Berger | 446/237 |
| 2,757,482 | A | * | 8/1956 | Brown et al. | 446/6 |
| 2,803,920 | A | * | 8/1957 | Salosky | 446/6 |
| 3,000,137 | A | * | 9/1961 | Vine | 446/6 |
| 3,391,936 | A | * | 7/1968 | Grimes | 473/439 |
| 3,573,867 | A | * | 4/1971 | Mehrens | 473/439 |
| 3,675,921 | A | * | 7/1972 | Meyers, Sr. | 473/448 |
| 3,680,861 | A | * | 8/1972 | Schmidt | 473/444 |
| 3,856,104 | A | | 12/1974 | Ohba | |
| 3,927,879 | A | * | 12/1975 | Long et al. | 482/83 |
| 3,997,160 | A | * | 12/1976 | George | 473/444 |
| 4,168,062 | A | * | 9/1979 | McCarthy et al. | 473/446 |
| 4,295,292 | A | * | 10/1981 | Fitzgerald et al. | 446/6 |
| 4,451,037 | A | * | 5/1984 | O'Hare | 473/445 |
| 4,477,076 | A | | 10/1984 | Monaco | |
| 4,508,516 | A | | 4/1985 | D'Andrade et al. | |
| 4,519,787 | A | * | 5/1985 | Williams | 472/97 |
| 4,534,557 | A | * | 8/1985 | Bigelow et al. | 473/442 |

(Continued)

FOREIGN PATENT DOCUMENTS

| | | | | | |
|---|---|---|---|---|---|
| GB | 2027349 | A | * | 2/1980 | A63H 30/04 |
| WO | WO 2010122540 | A2 | * | 10/2010 | A63B 69/34 |

OTHER PUBLICATIONS

International Search Report, mailed Feb. 27, 2013, PCT International Patent App. No. PCT/US2012/050188, Allied Power Products, Inc., 5 pgs.

(Continued)

*Primary Examiner* — Mitra Aryanpour

(74) *Attorney, Agent, or Firm* — Chernoff, Vilhauer, McClung & Stenzel, LLP

(57) ABSTRACT

A practice dummy comprising a remotely controlled, self-propelled base unit supporting a detachable upper body enables athletes to practice football skills against a dummy that can simulate the speed and mobility of a human player.

2 Claims, 3 Drawing Sheets

(56) References Cited

U.S. PATENT DOCUMENTS

| | | | | |
|---|---|---|---|---|
| 4,709,771 | A | 12/1987 | Basham et al. | |
| 4,816,998 | A | 3/1989 | Ahlbom | |
| 4,911,669 | A * | 3/1990 | Parker | 446/6 |
| 5,110,124 | A * | 5/1992 | Micco | 473/441 |
| 5,180,023 | A | 1/1993 | Reimers | |
| 5,335,906 | A | 8/1994 | Delker | |
| 5,636,834 | A | 6/1997 | Horkan | |
| 5,713,783 | A * | 2/1998 | Szoke et al. | 446/456 |
| 5,759,083 | A * | 6/1998 | Polumbaum et al. | 446/435 |
| 5,836,837 | A * | 11/1998 | Craig | 473/472 |
| 6,106,443 | A * | 8/2000 | Kuo | 482/83 |
| 6,168,160 | B1 * | 1/2001 | DeOreo et al. | 273/374 |
| 6,315,630 | B1 * | 11/2001 | Yamasaki | 446/275 |
| 6,575,852 | B2 * | 6/2003 | Orner | 473/438 |
| 6,796,915 | B2 | 9/2004 | Getchell | |
| 6,893,384 | B2 * | 5/2005 | Triani | 482/83 |
| 7,001,099 | B2 | 2/2006 | Rittenhouse et al. | |
| 7,131,917 | B2 | 11/2006 | Spencer | |
| 7,147,579 | B2 * | 12/2006 | Forrest | 473/441 |
| 7,156,760 | B2 * | 1/2007 | Berdugo et al. | 473/439 |
| 7,258,591 | B2 * | 8/2007 | Xu | A63H 33/26 446/273 |
| 7,288,034 | B2 * | 10/2007 | Woodard et al. | 473/479 |
| 7,318,766 | B2 * | 1/2008 | Marine et al. | 446/359 |
| 7,357,760 | B1 * | 4/2008 | Rios | 482/90 |
| 7,658,689 | B2 * | 2/2010 | Crook, II | 473/447 |
| 7,887,459 | B2 * | 2/2011 | Ungari et al. | 482/1 |
| 7,951,045 | B1 * | 5/2011 | Brader | 482/3 |
| 7,984,910 | B1 * | 7/2011 | Nielsen | 273/359 |
| 8,007,367 | B2 * | 8/2011 | Dilz et al. | 473/151 |
| 2004/0182614 | A1 * | 9/2004 | Wakui | B25J 5/007 180/7.1 |
| 2004/0219498 | A1 * | 11/2004 | Davidson | 434/247 |
| 2006/0106496 | A1 * | 5/2006 | Okamoto | 700/253 |
| 2006/0126918 | A1 * | 6/2006 | Oohashi et al. | 382/153 |
| 2007/0215136 | A1 * | 9/2007 | Seguin | A63F 7/06 124/78 |
| 2008/0026918 | A1 | 1/2008 | Lemke et al. | |
| 2008/0282494 | A1 * | 11/2008 | Won et al. | 15/319 |
| 2009/0291781 | A1 | 11/2009 | Caruso | |
| 2010/0032224 | A1 * | 2/2010 | Liu | B25J 5/007 180/218 |
| 2010/0035724 | A1 * | 2/2010 | Ungari et al. | 482/4 |
| 2010/0041517 | A1 * | 2/2010 | Ungari et al. | 482/8 |
| 2010/0048363 | A1 * | 2/2010 | Gilberti et al. | 482/105 |
| 2010/0240278 | A1 * | 9/2010 | Neal et al. | 446/489 |
| 2011/0089639 | A1 * | 4/2011 | Bellamy et al. | 273/359 |
| 2011/0256990 | A1 * | 10/2011 | Machado et al. | 482/83 |

OTHER PUBLICATIONS

Driver's Ed Guide Instruction Manual for All Castle Creations Car and Truck Brushless Power Systems, Jan. 2011; Castle Creations, Inc., Olathe, Kansas.

* cited by examiner

MOBILE PRACTICE DUMMY

CROSS-REFERENCE TO RELATED APPLICATIONS

Not applicable.

BACKGROUND OF THE INVENTION

The present invention relates to practice dummies used to teach football skills to athletes and, more particularly, to a mobile, remotely controlled practice dummy particularly useful for teaching and practicing skills to be employed with mobile opponents.

Practice dummies are widely used to teach tackling and blocking techniques and skills to football players. Practice dummies enable players to learn and practice proper technique while reducing bodily wear and tear and the potential for injury that accompanies live tackling and blocking drills with other players. Practice dummies typically comprise a simple padded structure which may be either handheld, freestanding or attached to a sled. The practice dummy is usually located in front of the player to provide a target for practicing blocking and tackling techniques. Sled mounted and standalone dummies provide resistance to the tackler and blocker simulating the resistance encountered in tackling and blocking a human player but provide only a static target. Dummies held by members of the coaching staff can be moved but movement is limited because the holder of the dummy typically must be stationary to resist the impact of the tackler or blocker and to avoid injury when the dummy is impacted. While practice dummies are useful for teaching basic blocking and tackling techniques, opposing players are not static objects and live drills with other players are typically required to teach techniques useful when the tackler or blocker is opposed by a human player who is moving while initiating or evading contact.

What is desired, therefore, is a practice dummy sufficiently mobile to simulate a human player.

DETAILED DESCRIPTION OF PREFERRED EMBODIMENTS

Figure 1:
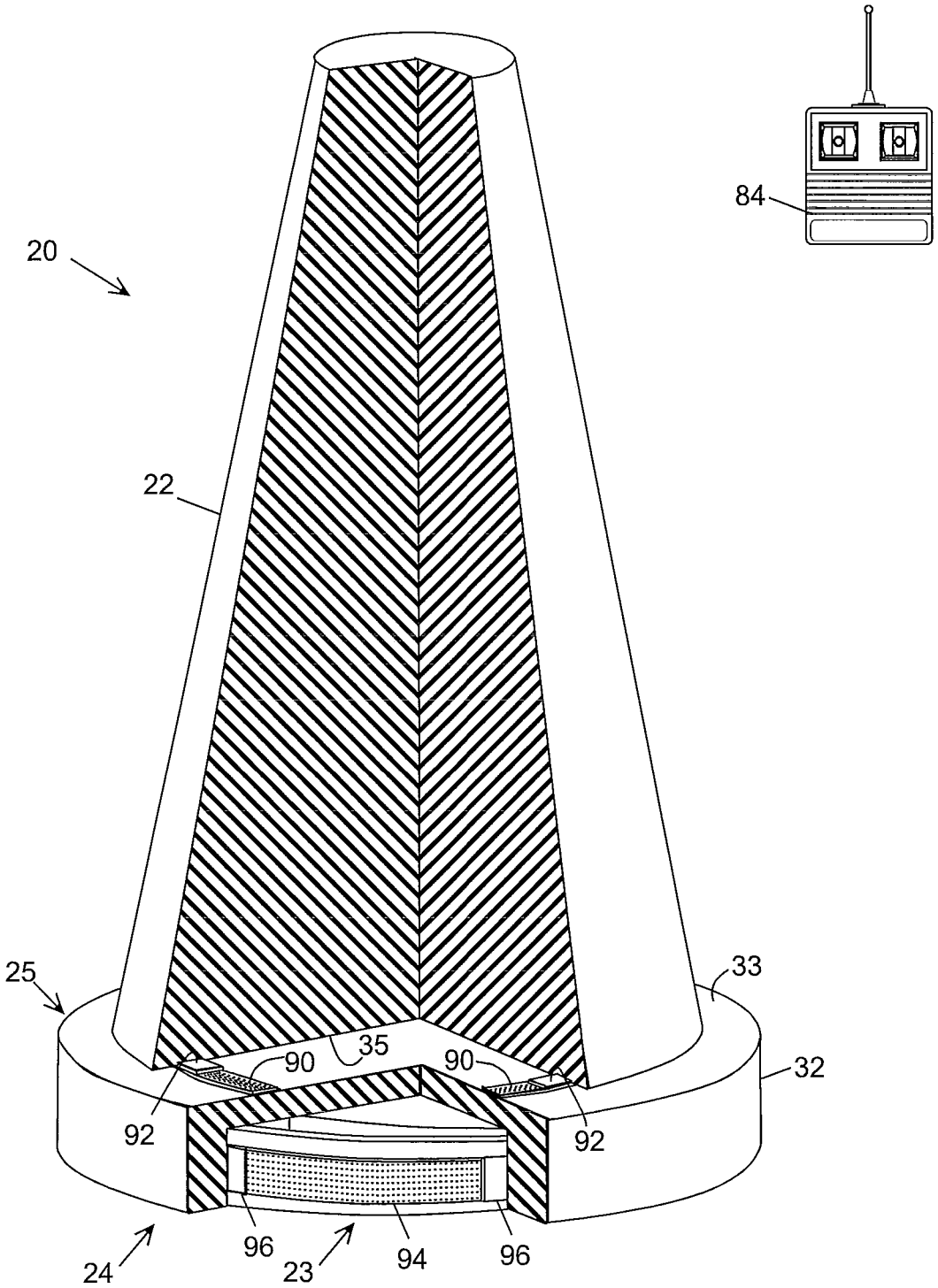
FIG. 1 is a partially cutaway perspective of an exemplary mobile practice dummy.
Figure 2:
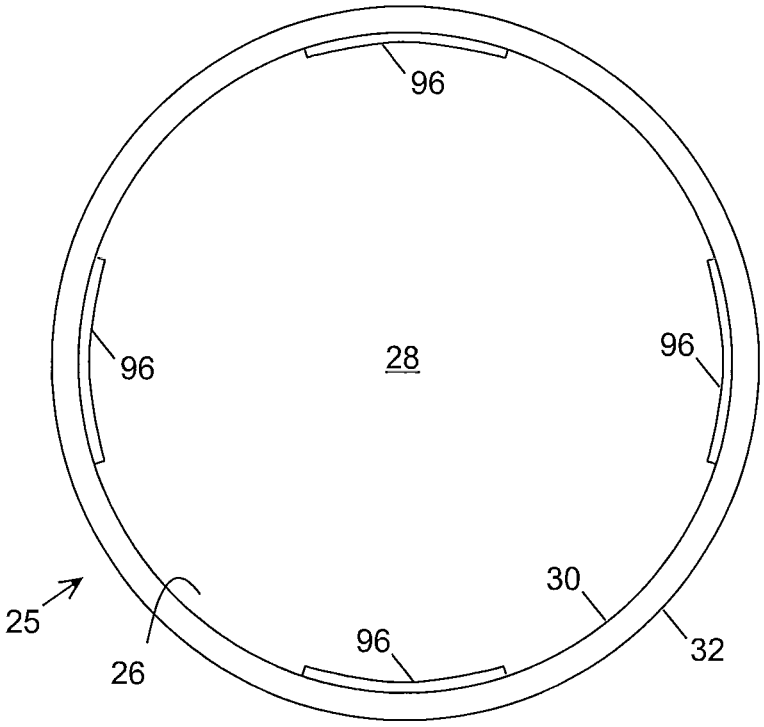
FIG. 2 is a bottom view of a cover portion of the exemplary mobile practice dummy of FIG. 1.
Figure 3:
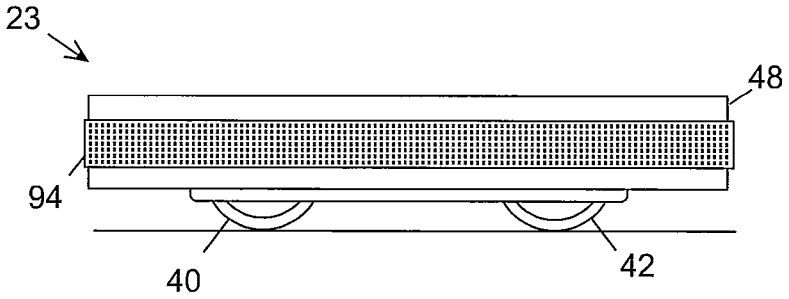
FIG. 3 is a side elevation view of a propulsion unit for the exemplary mobile practice dummy of FIG. 1.
Figure 4:
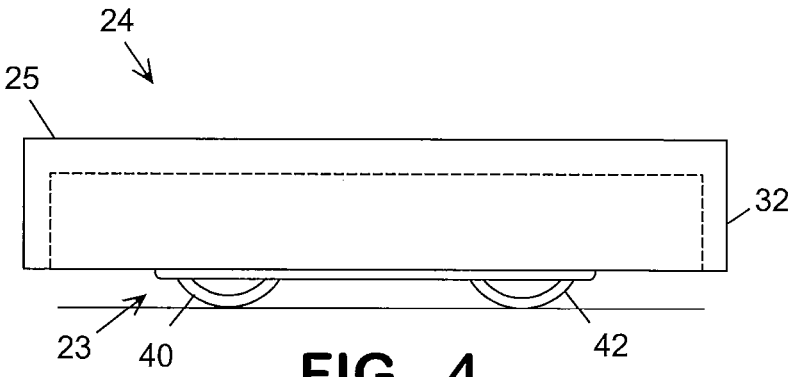
FIG. 4 is a side elevation view of a mobile base unit for the exemplary mobile practice dummy of FIG. 1.
Figure 5:
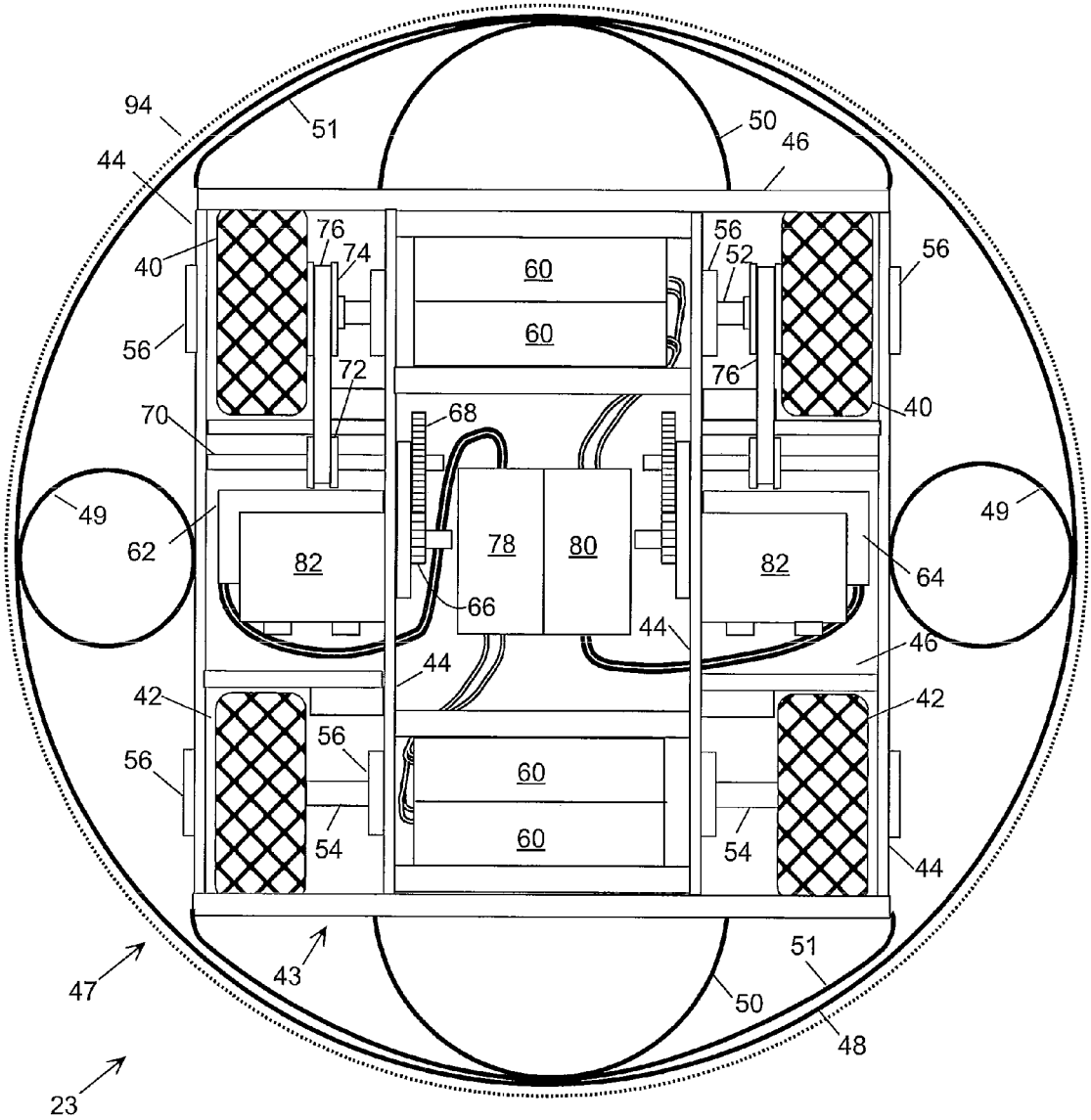
FIG. 5 is a plan view of the propulsion unit of FIG. 3.

Referring in detail to the drawings where similar parts are identified by like reference numerals, and, more particularly to FIG. 1, the mobile practice dummy 20 comprises generally an upper body 22 and a remotely controllable, self-propelled base unit 24. The upper body 22 comprises a pliant mass intended to simulate the body of an opposing player. The upper body preferably comprises a compressible material such as a plastic foam covered with an abrasion resistant outer shell such as a vinyl covering and may have a mass intended to simulate the mass of an opposing player. The upper body may be any shape including the shape of a human torso but commonly available practice dummies have a generally frustoconical shape as illustrated in FIG. 1.

Referring also to FIGS. 2, 3, 4 and 5, the base unit 24 is self-propelled and remotely controllable and comprises generally a propulsion unit 23 and a cover 25. The propulsion unit 23 comprises generally a chassis 43 supported by a plurality of ground engaging elements, for examples, wheels 40, 42 or caterpillar treads. The chassis comprises generally a plurality of longitudinal plates 44 spaced apart by and secured to each other by a plurality of lateral members 46.

The wheels 40, 42 are mounted on axles 52, 54 which rotate in bearings 56 that are secured to longitudinal chassis plates 44. Batteries 60, secured in the chassis, provide the energy to operate the self-propelled base unit. The exemplary base unit 24 is propelled and steered by two powered wheels 40, each driven by a respective motor 62, 64. Power is transferred to the respective wheel from its motor by a transmission comprising a gear set including a pinion 66 attached to the motor shaft and a driven gear 68 which rotates a jackshaft 70 rotatably supported in the chassis. A first pulley 72 attached to the jackshaft 70 is coupled by a drive belt 76 to a second pulley 74 which is drivingly connected to the respective powered wheel. The speed and direction of rotation of each motor 62, 64 are separately controllable by a respective electronic speed controller 78, 80. The electronic speed controllers 78, 80 respond to signals from at least one receiver 82 of electromagnetic signals by applying variable width electrical pulses to the respective motors. The motor responds to the pulses by rotating at substantially the same speed as it would if it was excited by a continuous voltage equal to the time weighted average voltage of the series of pulses. Although signals in another portion of the electromagnetic spectrum, such as infrared light, might be used to control the practice dummy, the receiver 82 is typically a radio frequency receiver receiving signals from a remote radio frequency transmitter 84 which is typically operated by a member of the coaching staff. The operator is able to remotely control the speed and direction of rotation of the individual motors and thereby the speed and direction of the mobile practice dummy to simulate the actions of a human player.

A resilient bumper assembly 47 substantially encircles the chassis 43 of the propulsion unit. The bumper assembly preferably comprises a resilient outer bumper band 48 that substantially encircles the chassis and resilient supporting bumper bands 49, 50, 51 which are affixed to respective longitudinal and lateral members 44, 46 defining the perimeter of the chassis. The bumper bands which preferably comprise a resilient plastic, such as an ultra-high molecular weight (UHMW) plastic, resiliently deform when the propulsion unit comes in contact with another object, such as a player, to protect the propulsion unit and the other object.

The cover 25 is generally cylindrical in shape and preferably comprises resilient plastic foam covered with an abrasion resistant outer shell, such as vinyl. The cover includes a portion, in the underside of the cover, defining a cavity 26 that is arranged to fit over the propulsion unit and an upper interface surface 33 to engage and support the upper body 22 when it is installed on the base unit 24. The cover is supported by the propulsion unit and the cavity 26 includes a base surface 28 and a side wall 30 which is arranged to encircle and engage the outer bumper band 48 to support the cover and aid in restraining lateral displacement of the cover and the upper body when the speed and direction of the base unit changes. The cover 25 is detachably restrained to the propulsion unit 24 by a first element 94 and a complementary second element 96 of a hook and loop fastener affixed respectively to the outer bumper band 48 and to the sidewall 30 of the cavity 26 in the cover. The restraint provided by the hook and loop fastener reduces the likelihood of separation of the cover when the speed or direction of the dummy changes or when the dummy is impacted or tipped by a blocker or tackler but allows removal the cover for access to the propulsion unit. The side wall 30 is the inner surface of a skirt portion 32 of the cover 25 which encircles the base unit. When a tackler or blocker engages the upper body 22 it is possible that the player will make contact with the base unit as well. The resilient skirt 32 prevents direct contact with the bumper of the propulsion unit and reduces the likelihood that the blocker or tackler will make contact with more rigid elements of the propulsion unit.

A significant portion of the practice dummy's weight is represented by the base unit 24 and the low center of mass of the practice dummy enables rapid direction and speed changes without tipping, simulating the speed and mobility of a human player. The inventor realized that the upper body could tip or slide and become detached from the mobile base unit during rapid maneuvering. In addition, when a tackler or blocker makes contact with the upper body of the practice dummy, the force of the contact will tend to overturn the practice dummy and, if the base unit remained attached to the upper body and tipped, with the upper body the tackler or blocker could fall on the upturned base unit. To reduce the likelihood of contact between a player and the base unit and to retain the upper body during rapid maneuvering, the inventor arranged the upper body 22 to be supported by and restrained to the base unit, but separable from the base unit 24 when the upper body is contacted by another object such as a player tackling or blocking the dummy. Although other mechanisms for increasing the separation resistance of the engaged surfaces of the upper body and the base unit, such as magnets, might be used, the inventor concluded that separability with an appropriate resistance to separation could be achieved by affixing portions of first element 90 and a complementary second element 92 of a hook and loop fastener to respective portions of surfaces, the interface surface 33 of the cover and the supporting surface 35 of the upper body, which engage each other when the upper body is installed on the base unit.

The self-propelled, remotely controlled practice dummy can simulate the speed and mobility of a human athlete enabling potential tacklers and blockers to practice appropriate techniques for engaging other players without engaging in live drills with other players. Releasably securing the upper body to the mobile base unit allows the practice dummy to change speed and direction rapidly without separating the upper body from the base unit but allows separation of the upper body and the base unit when a player tackles or blocks the dummy.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

We claim:

1. A tackling dummy for improving a user's blocking and tackling techniques, comprising:

a tackling dummy having an upper body and a lower body;

said upper body simulating an opposed player and said lower body including a self-propelled base;

said self-propelled base including ground engaging elements and means for remotely controlling said ground engaging elements of said tackling dummy;

wherein when sufficient force is applied by a user on said upper body, said upper body of said tackling dummy becomes detachable from said lower body.

2. A tackling dummy for improving a user's blocking and tackling techniques, comprising:

a tackling dummy having a pliant upper body and a lower body;

said pliant upper body simulating an opposed player and said lower body including a self-propelled base;

said self-propelled base including ground engaging elements and means for remotely controlling said ground engaging elements of said tackling dummy;

a cover detachably supported by the lower body;

a first attachment element affixed to a supporting surface of the upper body; and a second attachment element affixed to an interface portion of the cover such that the second attachment element engages the first attachment element when the supporting surface of the upper body is supported by the interface portion of the cover, engagement of the first and second attachment elements restraining separation to enable direction and speed changes of the tackling dummy without separating the upper body and the lower body but permitting separation of the upper body from the lower body when sufficient force is applied by a user to the upper body of the tackling dummy.

* * * * *